United States Patent [19]

Silverberg

[11] 4,189,223

[45] Feb. 19, 1980

[54] STEERING AND SUPPORTING SYSTEM FOR A PHOTOCONDUCTIVE BELT

[75] Inventor: Morton Silverberg, Rochester, N.Y.

[73] Assignee: Xerox Corporation, Stamford, Conn.

[21] Appl. No.: 922,720

[22] Filed: Jul. 7, 1978

[51] Int. Cl.[2] ..... G03G 15/00

[52] U.S. Cl. ..... 355/3 BE; 74/241; 198/811; 355/16

[58] Field of Search ..... 355/16, 3 R, 3 BE; 74/241; 198/811, 806, 807, 840

[56] References Cited

U.S. PATENT DOCUMENTS

| | | | |
|---|---|---|---|
| 756,600 | 4/1904 | Dodge | 198/811 |
| 2,274,268 | 2/1942 | Hercik | 74/241 |
| 2,687,885 | 8/1954 | Kroth | 74/241 X |
| 3,478,864 | 11/1969 | Hopkins | 198/811 |
| 3,726,588 | 4/1973 | Moser | 355/3 BE |

*Primary Examiner*—R. L. Moses

*Attorney, Agent, or Firm*—J. J. Ralabate; C. A. Green; H. Fleischer

[57] ABSTRACT

An apparatus in which an endless belt is at least partially supported on the fluid film in a predetermined path of movement. A pneumatic system, responsive to a deviation of the belt from the path of movement, restrains the movement of the belt to the pre-determined path of movement.

20 Claims, 3 Drawing Figures

STEERING AND SUPPORTING SYSTEM FOR A PHOTOCONDUCTIVE BELT

BACKGROUND OF THE INVENTION

This invention relates generally to an electrophotographic printing machine, and more particularly concerns an improved apparatus for supporting and maintaining the transverse alignment of a moving photoconductive belt.

In an electrophotographic printing machine, a photoconductive belt is charged to a substantially uniform potential so as to sensitize the surface thereof. Thereafter, the charged portion of the photoconductive belt is exposed to a light image of an original document being reproduced. Exposure of the charged photoconductive belt selectively discharges the charge thereon in the irradiated areas. This records an electrostatic latent image on the photoconductive belt corresponding to the informational areas contained within the original document being reproduced. After the electrostatic latent image is recorded on the photoconductive belt, the latent image is developed by bringing a developer mix into contact therewith. The developer mix comprises toner particles adhering triboelectrically to carrier granules. These toner particles are attracted from the carrier granules to the latent image forming a toner powder image thereon. The toner powder image is then transferred to a copy sheet. Finally, the copy sheet is heated to permanently affix the toner particles thereto in image configuration. This general approach was originally disclosed by Carlson in U.S. Pat. No. 2,297,691, and has been further amplified and described by many related patents in the art.

It is evident that the lateral alignment of the photoconductive belt is critical and must be controlled within prescribed tolerances. This is due to the fact that the photoconductive belt passes through many processing stations during the printing operation. As the belt passes through each of these processing stations, the location of the latent image must be precisely defined to optimize copy quality. Therefore, lateral movement of the photoconductive belt should be minimized so that the belt moves in a pre-determined path.

If the photoconductive belt was perfectly constructed and entrained about perfectly cylindrical rollers mounted and secured in an exactly parallel relationship with one another, there would be no lateral skewing of the belt. However, in actual practice, this is not feasible. Thus, the photoconductive belt must be tracked or controlled to regulate its lateral position. Existing methods of controlling the lateral movement of the photoconductive belt comprises various forms of crowned rollers, flanged rollers, and electrical servo systems. However, systems of this type frequently produce high local stresses resulting in damage to the sensitive photoconductive belt.

Accordingly, it is a primary object of the present invention to improve the support and lateral alignment of the photoconductive belt employed in an electrophotographic printing machine.

PRIOR ART STATEMENT

Various types of devices have hereinbefore been developed to improve the support and tracking of photoconductive belts. The following prior art appears to be relevant:

Wright et al.; U.S. Pat. No. 3,435,693; Apr. 1, 1969
Jones et al.; U.S. Pat. No. 3,500,694; Mar. 17, 1970
Stokes et al.; U.S. Pat. No. 3,702,131; Nov. 7, 1972
Vola; U.S. Pat. No. 3,846,021; Nov. 5, 1974
Rushing; U.S. Pat. No. 4,061,222; Dec. 6, 1977
Morse et al.; Research Disclosure, 14510, pg. 29, May, 1976

The pertinent portions of the foregoing prior art may be briefly summarized as follows:

Wright et al. discloses a belt entrained about rollers 4, 6, and 8. One end of the rollers are journaled in frame 40 which is pivotable. A sensing member 70 is forced to the right by the belt when it moves laterally. Sensing member 70 is connected by a linkage to frame 40. If the belt is forced against sensing member 70, the linkage rotates the frame to a position where the belt will track away from the sensing member until equilibrium is reached.

Jones et al. describes a belt tracking system in which a belt 12 is entrained about rollers 45, 46, and 47. Roller 46 is rocked by a motor actuated by a sensor adjacent belt 12. The motor positions roller 46 to force belt 12 in a direction opposed to the slipping direction.

Stokes et al. discloses a belt 12 journaled for continuous movement upon rollers 20, 21, and 22. Roller 21 is rotatably mounted in yoke 58. Yoke 58 is supported rockably on shaft 60. A sensor detects skewing of belt 12 and initiates rocking of yoke 58 to correct therefor.

Vola describes a system for maintaining an endless belt aligned. Belt 1 is entrained about guide rollers 19 and 20 and drive roller 22. Belt 1 is guided by roller 21 over aligning device 23. Aligning device 23 consists of a convex plate 24 having a layer 25 of napped material interposed between flanges 26 and 27. Belt 1 is held in close contact with napped surface 25 and pressed evenly against the surface. Flanges 26 and 27 guide the belt to the desired position.

Rushing discloses a belt 12 positioned about steering roller 14, idler roller 15, and drive roller 16.

Steering roller 14 is mounted rotatably on yoke 64. Yoke 64 is mounted pivotably about shaft 65. Sensor 54 detects the lateral movement of belt 12. The output signal from sensor 54 is processed by control logic which develops a signal driving gear motor 56. Gear motor 56 tilts yoke 64 causing steering roller 14 to force belt 12 into alignment.

Morse et al. describes a passive web tracking system. Web W is supported in a closed loop path by supports 20, 30, and 40. Support 20 includes a roller 24. Roller 24 is pivotable to align its axis of rotation 23 normal to the direction of travel of web W. Fixed flanges 26 engage the side edges of web W preventing lateral movement thereon.

It is believed that the scope of the present invention, as defined by the appended claims, is patentably distinguishable over the foregoing prior art taken either singly or in combination with one another.

SUMMARY OF THE INVENTION

Briefly stated, and in accordance with the present invention, there is provided an apparatus for tracking an endless belt in a pre-determined path of movement.

Pursuant to the features of the invention, the apparatus includes means for supporting the belt in the predetermined path of movement. Pneumatic means, responsive to a deviation of the belt from the pre-determined path, move the supporting means so that the belt tracks in the pre-determined path of movement.

BRIEF DESCRIPTION OF THE DRAWINGS

Other objects and advantages of the present invention will becme apparent upon reading the following detailed description and upon reference to the drawings, in which.

While the present invention will hereinafter be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 1:
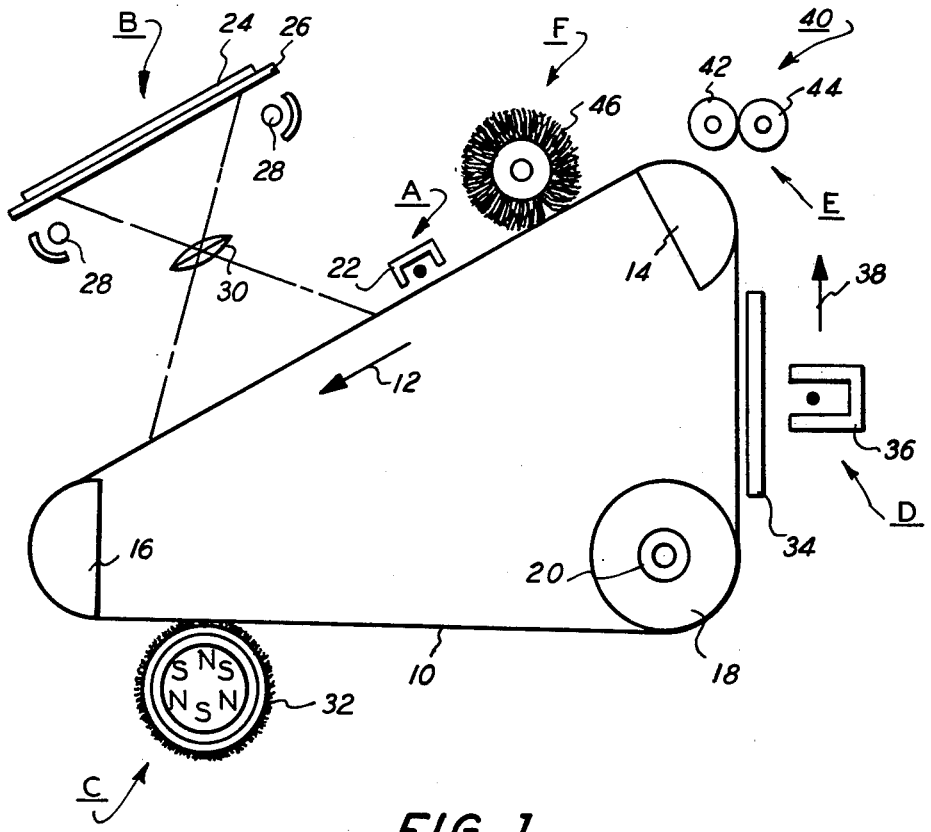
FIG. 1 is a schematic elevational view depicting an electrophotographic printing machine incorporating the features of the present invention therein.

For a general understanding of the illustrative electrophotographic printing machine incorporating the features of the present invention therein, reference is had to the drawings. In the drawings, like reference numerals have been used throughout to designate identical elements. FIG. 1 schematically depicts the various components of an electrophotographic printing machine employing the belt support and steering mechanism of the present invention therein. Although the belt steering and support mechanism is particularly well adapted for use in an electrophotographic printing machine, it will become evident from the following discussion that it is equally well suited for use in a wide variety of devices and is not necessarily limited in its application to the particular embodiment shown herein.

Inasmuch as the art of electrophotographic printing is well known, the various processing stations employed in the FIG. 1 printing machine will be shown hereinafter schematically, and their operation described briefly with reference thereto.

Figure 2:
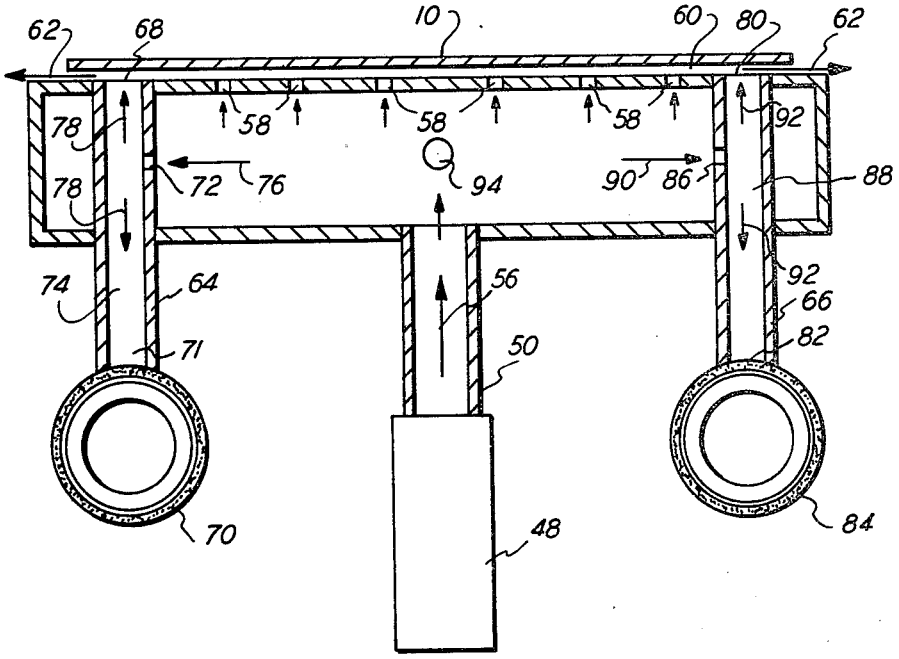
FIG. 2 is an elevational view illustrating the belt steering system employed in the FIG. 1 printing machine.
Figure 3:
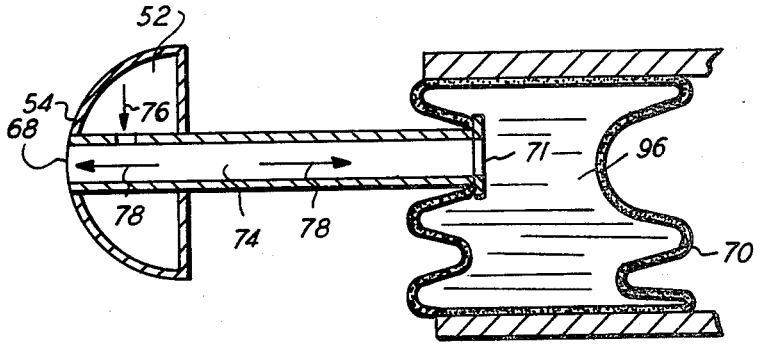
FIG. 3 is a side elevational view showing the operation of the pneumatic system used in the FIG. 2 belt steering system.

As shown in FIG. 1, the electrophotographic printing machine employs a belt 10 having a photoconductive surface, e.g. a selenium alloy, deposited on a conductive substrate, e.g. aluminum. Belt 10 moves in the direction of arrow 12 to advance sequentially through the various processing stations disposed about the path of movement thereof. Belt 10 is entrained about steering post 14, post 16 and drive roller 18. Post 14 is mounted pivotably and steers the belt to maintain it in a predetermined path of movement. Post 16 is stationary. Drive roller 18 is in engagement with belt 10 to advance belt 10 in the direction of arrow 12. Roller 18 is rotated by motor 20 coupled thereto. A blower system is connected to steering post 14 and stationary post 16. Both steering post 14 and post 16 have small holes in the circumferential surface thereof coupled to an interior chamber. The blower system furnishes pressurized fluid, i.e. a compressible gas such as air, into the interior chamber. The fluid engresses from the interior chamber through the apertures and forms a fluid film between belt 10 and the respective post, i.e. steering post 14 and fixed post 16. In this manner, the fluid film at least partially supports the belt as it passes over the respective post diminishing friction therebetween. Preferably, the same blower system is Ttem is connected to both steering ;ost 14 and fixed post 16. In this manner, a common blower system is employed for furnishing a pressurized fluid to at least partially support the belt as it passes over the respective post and for effecting steering of the belt. The details of the steering and support system are illustrated in FIGS. 2 and 3.

Initially, a portion of belt 10 passes through charging station A. At charging station A a corona generating device, indicated generally by the reference numeral 22, charges the photoconductive surface of belt 10 to a relatively high, substantially uniform potential. A suitable corona generating device is described in U.S. Pat. No. 2,836,725, issued to Vyverberg in 1958.

Next, the charged portion of photoconductive belt 10 is advanced through exposure station B. At exposure station B an original document 24 is positioned face down on transparent platen 26. Lamps 28 flash light rays onto the original document. Light rays reflected from the original document are transmitted through lens 30 forming a light image thereof. This light image is projected onto the charged portion of photoconductive belt 10. In this manner, the charged photoconductive surface of belt 10 is discharged selectively by the light image of the original document. This records an electrostatic latent image on the photoconductive surface of belt 10 which corresponds to the informational areas contained within original document 24.

Thereafter, belt 10 advances the electrostatic latent image recorded on photoconductive belt 10 to development station C. At development station C, a magnetic brush developer roller 32 advances a developer mix into contact with the electrostatic latent image recorded on the photoconductive surface of belt 10. The developer mix comprises carrier granules having toner particles adhering triboelectrically thereto. The magnetic developer roller forms a brush having a chain-like array of developer mix extending outwardly. The developer mix contacts the electrostatic latent image recorded on the photoconductive surface of belt 10. The latent image attracts the toner particles from the carrier granules forming a toner powder image on the photoconductive surface of belt 10.

The toner powder image recorded on the photoconductive surface of belt 10 is then transported to transfer station D. At transfer station D, a sheet of support material 34 is positioned in contact with the toner powder image deposited on the photoconductive surface of belt 10. A sheet of support material is advanced to the transfer station by a sheet feeding apparatus. Preferably, the sheet feeding apparatus includes a feed roll contacting the uppermost sheet of the stack of sheets of support material. The feed roll rotates so as to advance the uppermost sheet from the stack. Registration rollers align and forward the advancing sheet of support material into a chute. The chute directs the advancing sheet of support material into contact with photoconductive surface of belt 10 in a timed sequence so that the powder image developed thereon contacts the advancing sheet of support material material at transfer station D. Transfer station D includes a corona generating device 36 which applies a spray of ions to the backside of the sheet 34. This attracts the toner powder image from the photoconductive surface of belt 10 to sheet 34. After transfer, the sheet continues to move in the direction of arrow 38 and is separated from belt 10 by a detack corona generator (not shown) neutralizing the charge causing sheet 34 to adhere to belt 10. A conveyor system (not shown) advances the sheet from belt 10 to fusing station E.

Fusing station E includes a fuser assembly, indicated generally by the reference numeral 40, which permanently affixes the transferred toner powder image to sheet 34. Preferably, fuser assembly 40 includes a heated fuser roll 42 and a back-up roll 44. Sheet 34, having the toner powder image thereon, passes between fuser roll 92 and back-up roll 44 with the toner powder image contacting fuser roll 42. In this manner, the toner powder image is permanently affixed to sheet 34. After fusing, a series of conveyors (not shown) advance sheet 34 to a catch tray (not shown) for removal from the printing machine by the operator.

Invariably, after the sheet of support material is separated from the photoconductive surface of belt 10, some residual particles remain adhering to belt 10. These residual particles are removed from belt 10 at cleaning station F. Cleaning station F includes a rotatably mounted fiberous brush 46 in contact with the photoconductive surface of belt 10. The particles are cleaned from the photoconductive surface by the rotation of brush 46 in contact therewith. Subsequent to cleaning, a discharge lamp (not shown) floods the photoconductive surface of belt 10 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine.

Referring now to the specific subject matter of the present invention, FIG. 2 depicts the operation of steering post 14 in greater detail.

Turning now to FIG. 2, there is shown the detailed structure of steering post 14 and the pneumatic system associated therewith for pivoting it to cause photoconductive belt 10 to track in a stable lateral position. One technique for causing the photoconductive belt 10 to track in a stable lateral position is to sense the belt edge position and then to utilize that information to controllably pivot post 14. It is particularly advantageous to pneumatically sense the belt's position and then to utilize this information to pneumatically generate the desired corrective action. This is particularly advantageous when the photoconductive belt is supported by a fluid film. Thus, it is highly efficient to utilize a common pneumatic system for furnishing a fluid film for supporting, at least partially, the photoconductive belt and for sensing the lateral edge thereof and introducing corrective steering action thereto. As shown in FIG. 2 and FIG. 3, steering post 14 includes a post 54 having an interior chamber 52. Blower 48 is coupled, via conduit 50, to interior chamber 52 of post 54. Compressed air is furnished from blower 48 and it moves in the direction of arrow 56 into chamber 52 of post 54. Post 54 includes a plurality of apertures 58 in the circumferential surface thereof. Compressed air flows through aperture 58 into gap 60 between belt 10 and the circumferential surface of post 54. The compressed air is under pressure and supplies a supporting force for belt 10 so as to at least partially space belt 10 from the circumferential surface of post 54 minimizing friction therebetween as belt 10 moves in the direction of arrow 12 (FIG. 1). Air moves in gap 60 laterally outwardly, in the direction of arrow 62, to escape to the atmosphere at the side marginal regions of belt 10. It is, thus, seen that the pneumatic system provides one function, i.e. the generation of a pressurized fluid for at least partially supporting the photoconductive belt spaced from post 14 so as to minimize friction therebetween as belt 10 moves thereabout.

Considering now the manner in which the pneumatic system further functions to provide steering, sensing tubes 64 and 66 are positioned at opposed end portions of post 54. One open end portion 68 of sensing tube 64 is disposed beneath one side marginal region of belt 10. The other open end portion 71 of tube 64 is connected to the interior chamber of a rubber bladder or flexible bellows 70. Aperture 72, in the circumferential surface of tube 64, permits pressurized fluid to pass from chamber 52 into interior chamber 74 of tube 64. Thus, the compressed fluid enters through aperture 72 into chamber 74. If belt 10 covers open end portion 68 of tube 64, the pressure in chamber 74 of tube 64 rises and is substantially equal to the pressure within chamber 52 of post 54. Thus, it is seen that pressurized fluid flows in the direction of arrow 76 through aperture 72 in tube 64 and in the directions of arrows 78 in tube 64. Inasmuch as the interior chamber of bellow 70 is connected to chamber 74 of tube 64, the pressure thereof is substantially equal to the pressure within chamber 74 of sensing tube 64. Contrawise, if open end 68 is uncovered by belt 10, the pressure within chamber 74 drops to atmospheric pressure. This, in turn, reduces the pressure within the chamber of bellows 70. Open end 68 may be in the form of a slot or tube ends which can be progressively covered varying the pneumatic resistance between the tube exit and belt edge.

With continued reference to FIG. 2, sensing tube 66 is disposed at the other end of post 54 opposed from the end thereof having sensing tube 64. Open end portion 80 of sensing tube 66 is positioned beneath the other side marginal region of belt 10. The other open end portion 82 of tube 66 is connected to the interior chamber of a rubber bladder, or flexible bellows 84. Aperture 86, in the circumferential surface of tube 66 connects interior chamber 88 of tube 66 with chamber 52. This permits the pressurized fluid to move from chamber 52, in the direction of arrow 90, into chamber 88. Since the interior chamber of bellows 84 is connected to chamber 82, the pressurized fluid flows in the direction of arrows 92 thereto. Thus, the internal pressure within bellows 84 is substantially the same as within chamber 52. However, if belt 10 moves laterally uncovering open end 80, the pressure within bellows 84 drops to atmospheric.

Post 54 is supported pivotably in a yoke (not shown). The yoke includes a U-shaped member having post 54 mounted fixedly therein. A rod extends from the center of the U-shaped member and is mounted rotatably in a fixed frame. Preferably, the rod is supported in a suitable bearing minimizing friction during the pivoting thereof. The longitudinal axis of the rod is substantially coincident with pivot point 94 and normal to the longitudinal axis of post 54. In this manner, post 54 pivots about point 94. The pressure differential between bellows 70 and 84 produces a moment pivoting post 84 to align belt 10 in the pre-determined path of movement.

In operation, if belt 10 moves laterally to uncover open end 68 of sensing tube 64, the pressure within bellows 70 drops to atmospheric pressure. This causes bellows 70 to return to its normal un-extended state. Contrawise, since the force exerted by bellows 70 is reduced, bellows 84 expands compressing bellows 70. This causes post 54 to pivot about point 94 in a counterclockwise direction, belt 10 is forced to return to its pre-determined path of movement. Thus, thereby forcing belt 10 to move in a direction so as to once again cover open end 68 of tube 64 returning bellows 70 and 84 to substantially the same pressure.

Contrawise, if belt 10 moves laterally in the opposite direction, open end 80 of tube 66 is uncovered. This reduces the pressure in bellows 84 to atmospheric causing post 54 to pivot in a clockwise direction. As post 54 pivots in a clockwise direction, it forces belt 10 to return to the desired path covering open end 80. Thus, the pneumatic system senses the direction of lateral movement of belt 10 and tilts the support post in a direction appropriate for restoring belt 10 to the desired path of movement. Referring now to FIG. 3, there is shown the operation of sensing tube 64 in greater detail. As previously noted, open end portion 68 of sensing tube 64 is positioned beneath one side marginal region of photoconductive belt 10. The other open end portion 71 of sensing tube 64 is connected to the interior chamber 96 of bellows 70. When the side marginal region of photoconductive belt 10 covers opening 68, pressurized fluid from chamber 52 flows into chamber 74 in the direction of arrows 76 and 78. As the pressurized fluid flows in the direction of these arrows, it enters into chamber 96 of bellows 70. In this manner, chamber 96 of bellows 70, chamber 74 of tube 64, and chamber 52 of post 54 are all of substantially the same pressure. When belt 10 covers opened end portion 80 of sensing tube 66, and open end portion 68 of sensing tube 64, bellows 70 and 74 are at the same pressure and post 54 is in equilibrium. Contrawise, if belt 10 skews laterally uncovering either open end portion 68 of tube 64 or open end portion 80 of tube 66, a pressure differential is created between bellows 70 and bellows 84. This pressure differential results in a pivoting moment being applied to post 54. This pivoting moment tilts post 54 in a direction opposed to the movement of belt 10 driving belt 10 back to the predetermined path of movement thereof.

While the present invention has been described as comprising a pair of sensing tubes and bellows, one skilled in the art will appreciate that one sensing tube and bellows in conjunction with a spring may be employed in lieu thereof. In this latter embodiment, one end of a spring is fixed and the other end thereof connected to one end of the steering post. The sensing tube and bellows are located at the other end of the tube end in a slot with the photoconductive belt covering a predetermined portion of the slot. The pneumatic movement produced by the bellows balances the spring movement. If the belt covers a greater portion of the slot than the pre-determined portion, the pneumatic movement increases pivoting the steering post to return the belt to its pre-determined path of movement. Contrawise, if the belt covers a lesser portion of the slot, the pneumatic movement decreases as the steering post pivots to return the belt to the pre-determined path of movement. The spring force and variatim in pneumatic resistance produce a differential control movement maintaining the belt in the pre-determined path.

In recapitulation, it is evident that the apparatus of the present invention produces a fluid film for at least partially supporting the photoconductive belt as it passes over a post. This significantly reduces friction therebetween and minimizes belt driving power. In addition, the same pneumatic system furnishing the fluid film for support of the belt, senses any belt lateral movement and develops a steering moment to restore the photoconductive belt to the pre-determined path of movement preventing lateral skewing thereof.

It is, therefore, evident that there has been provided in accordance with the present invention, an apparatus for supporting and steering a photoconductive belt that fully satisfies the objects, aims, and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations as fall witin the spirit and broad scope of the appended claims.

What is claimed is:

1. An apparatus for tracking an endless belt in a predetermined path of movement, including:

means for supporting said belt, said supporting means includes a pivotably mounted post defining an interior chamber; and pneumatic means, in communication with the interior chamber of said post and being responsive to a deviation of the belt from the pre-determined path of movement, for pivoting said post so that the belt tracks in the pre-determined path of movement.

2. An apparatus as recited in claim 1, wherein said pneumatic means includes:

means for supplying a pressurized fluid to the chamber of said post;

at least one sensing tube in communication with the chamber of said post, said tube having one open end thereof disposed at least partially beneath one side marginal region of the belt;

means for applying a resilient force to said post in the region of the other sie marginal region of the belt; and at least one bellows in communication with the other open end of said tube, said applying means and said bellows producing substantially equal forces when the belt covers a pre-determined portion of the open end of said tube and a differential force pivoting said post to restore the belt to the pre-determined path of movement when the belt covers a portion of the open end of said tube differing from the pre-determined portion thereof.

3. An apparatus as recited in claim 2, wherein said applying means includes a spring having one end portion thereof coupled to the marginal end region of said post disposed beneath the other side marginal region of the belt.

4. An apparatus as recited in claim 2, wherein said applying means includes:

a second sensing tube in communication with the chamber of said post, said second tube having one open end thereof disposed at least partially beneath the other side marginal region of the belt; and a second bellows in communication with the other open end of said second tube, said first mentioned bellows and said second bellows producing substantially equal forces when the belt cover predetermined portions of the open ends of said first mentioned tube and said second tube, and a differential force pivoting said post to restore the belt to the pre-determined path of movement when the belt covers portions of the open ends of said first mentioned tube and said second tube differing from the pre-determined portions thereof.

5. An apparatus as recited in claim 1, further including a source of pressurized fluid in communication with said post for generating a film of fluid between said post and the belt to reduce friction therebetween.

6. An apparatus as recited in claim 5, further including a substantially fixed post spaced from said pivotably mounted post for supporting the belt, said source of pressurized fluid being in communication with said fixed post to generate the film of fluid between said fixed post and the belt to reduce friction therebetween.

7. An apparatus as recited in claims 1 or 6, further including:

a drive roller in engagement with the belt; and means for rotating said drive roller to advance the belt along the pre-determined path of movement thereof.

8. A reproducing machine of the type having an endless photoconductive belt advancing about a predetermined path through a plurality of processing stations disposed thereabout, including:

means for supporting the belt, said supporting means includes a pivotably mounted post defining an interior chamber; and pneumatic means, in communication with the interior chamber of said post and being responsive to a deviation of the belt from the pre-determined path, for pivoting said post so that the belt tracks in the pre-determined path of movement.

9. A reproducing machine as recited in claim 8, wherein said pneumatic means includes:

means for supplying a pressurized fluid to the chamber of said post;

at least one sensing tube in communication with the chamber of said post, said sensing tube having one open end thereof disposed beneath one side margin region of the belt;

means for applying a resilient force to said post in the region of the other side marginal region of the belt; and at least one bellows in communication with the other open end of said tube, said applying means and said bellows producing substantially equal forces when the belt covers a pre-determined portion of the open end of said tube and a differential force pivoting said post to restore the belt to the pre-determined path of movement when the belt covers a portion of the open end of said tube differing from the predetermined portion thereof.

10. A reproducing machine as recited in claim 9, wherein said applying means includes a spring having one end portion thereof coupled to the marginal end region of said post disposed beneath the other side marginal region of the belt.

11. A reproducing machine as recited in claim 9, wherein said applying means includes:

a second sensing tube in communication with the chamber of said post, said second tube having one open end thereof disposed at least partially beneath the other side marginal region of the belt; and a second bellows in communication with the other open end of said second tube, said first mentioned bellows and said second bellows producing substantially equal forces when the belt covers predetermined portions of the open ends of said first mentioned tube and said second tube, and a differential force pivoting said post to restore the belt to the pre-determined path of movement when the belt covers portions of the open ends of said first mentioned tube and said second tube differing from the pre-determined portions thereof.

12. A reproducing machine as recited in claim 10, further including a source of pressurized fluid in communication with said post for generating a film of fluid between said post and the belt to reduce friction therebetween.

13. A reproducing machine as recited in claim 12, further including a substantially fixed post spaced from said pivotably mounted post for supporting the belt, said source of pressurized fluid being in communication with said fixed post to generate a film between said fixed post and the belt to reduce friction therebetween.

14. A reproducing machine as recited in claims 8, or 13, further including:

a drive roller in engagement with the belt; and means for rotating said drive roller to advance the belt along the pre-determined path of movement.

15. An electrophotographic printing machine of the type having an endless photoconductive belt arranged to have a latent image of an original document being reproduced recorded thereon, wherein the improvement includes:

means for defining a pre-determined path of movement of the belt;

means for supplying a pressurized fluid between at least a portion of said path defining means and the belt to form a fluid film supporting the belt and reducing friction between the belt and said path defining means, said path defining means includes a pivotably mounted post defining an interior chamber in communication with said supplying means and having a plurality of apertures in the periphery thereof through which pressurized fluid flows to form the fluid film between the post and the portion of the belt passing thereover; and pneumatic means, responsive to a deviation of the belt from the pre-determined path of movement, for adjusting said path defining means so that the belt tracks in the predetermined path of movement.

16. A printing machine as recited in claim 15, wherein said pneumatic means includes:

at least one sensing tube in communication with the chamber of said post, said tube having an open end thereof disposed beneath one side marginal region of the belt;

means for applying a resilient force to said post in the region of the other side marginal region of the belt; and at least one bellows in communication with the other open end of said tube, said applying means and said bellows producing substantially equal forces when the belt covers a pre-determined portion of the open end of said tube and a differential force pivoting said post to restore the belt to the pre-determined path of movement when the belt covers a portion of the open end of said tube differing from the pre-determined portion thereof.

17. A printing machine as recited in claim 16, wherein said applying means includes a spring having one end portion thereof coupled to the marginal end region of said post disposed beneath the other side marginal region of the belt.

18. A printing machine as recited in claim 16, wherein said applying means includes:

a second sensing tube in communication with the chamber of said post, said second tube having one open end thereof disposed at least partially beneath the other side marginal region of the belt; and a second bellows in communication with the other open end of said second tube, said first mentioned bellows at said second bellows producing substantially equal forces when the belt covers pre-determined portions of the open ends of said first mentioned tube and said second tube, and a differential force pivoting said post to restore the belt to the pre-determined path of movement when the belt covers portions of the open ends of said first mentioned tube and said second tube differing from the pre-determined portions thereof.

19. A printing machine as recited in claim 18, wherein said path defining means includes a substantially fixed post spaced from said pivotably mounted post for supporting the belt, said supplying means being in communication with said fixed post to generate a film of fluid between said fixed post and the belt to reduce friction therebetween.

20. A printing machine as recited in claim 19, wherein said path defining means includes:

a drive roller in engagement with the belt; and means for rotating said drive roller to advance the belt along the pre-determined path of movement thereof.

* * * * *